US005711486A

United States Patent [19]

Clark et al.

[11] Patent Number: 5,711,486

[45] Date of Patent: Jan. 27, 1998

[54] POP-UP SPRINKLER UNIT WITH PRESSURE RESPONSIVE EXTENDABLE AND RETRACTABLE SEAL

[75] Inventors: Mike Clark, San Marcos; Roger Wilby, Fallbrook; Kyle Capen, Temecula, all of Calif.

[73] Assignee: Hunter Industries, Inc., San Marcos, Calif.

[21] Appl. No.: 594,726

[22] Filed: Jan. 31, 1996

[51] Int. Cl.[6] ..... B05B 15/10

[52] U.S. Cl. ..... 239/205; 239/206

[58] Field of Search ..... 239/200, 201, 239/202, 203, 204, 205, 206, DIG. 1, 237; 277/205, 212 F

[56] References Cited

U.S. PATENT DOCUMENTS

| | | | |
|---|---|---|---|
| 1,853,805 | 4/1932 | Elder | 239/205 |
| 3,583,638 | 6/1971 | Eby | 239/206 |
| 3,724,757 | 4/1973 | Hunter | 239/205 |
| 4,055,205 | 10/1977 | Withoff et al. | 277/212 F |
| 4,113,181 | 9/1978 | Sheets | 239/206 |
| 4,316,579 | 2/1982 | Ray et al. | 239/205 |
| 4,399,999 | 8/1983 | Wold | 277/205 |
| 4,429,832 | 2/1984 | Sheets | 239/204 |
| 4,739,997 | 4/1988 | Smetana | 277/205 |
| 4,763,838 | 8/1988 | Holcomb | 239/205 |
| 4,781,327 | 11/1988 | Lawson et al. | 239/203 |
| 4,796,809 | 1/1989 | Hunter | 239/205 |
| 4,834,289 | 5/1989 | Hunter | 239/205 |
| 5,123,597 | 6/1992 | Bendall | 239/124 |
| 5,328,178 | 7/1994 | Nies | 277/205 |
| 5,423,486 | 6/1995 | Hunter | 239/205 |

*Primary Examiner*—Andres Kashnikow
*Assistant Examiner*—Lisa Ann Douglas
*Attorney, Agent, or Firm*—Baker, Maxham, Jester & Meador

[57] ABSTRACT

A pop-up sprinkler unit for mounting beneath the surface of a soil formation includes an outer cylindrical housing for subsurface mounting, with an inner housing carrying a nozzle and drive turbine reciprocally mounted in the outer housing for extending up through a portion of the soil and pressure responsive seals disposed between the inner and outer housings for sealing at predetermined pressures.

19 Claims, 3 Drawing Sheets

POP-UP SPRINKLER UNIT WITH PRESSURE RESPONSIVE EXTENDABLE AND RETRACTABLE SEAL

BACKGROUND OF THE INVENTION

The present invention relates to sprinkler units, and pertains particularly to improvements in seals in subsurface mounted pop-up sprinkler units.

Sprinkler units which are normally retracted into a housing in the ground when not in use, and which extend from a housing to a position above the surface of the ground when water pressure is applied, are widely used in both residential and commercial applications. These sprinkler units typically employ an inner housing, typically called a riser, retractably mounted in a protectively fixed outer housing, such that the top of the sprinkler unit is typically at ground surface level when not in use. The inner housing is sealed in the outer housing by seals fixed to the outer housing and wipe the surface of the inner housing as it extends from and retracts into the outer housing.

In many applications of retractable sprinkler units, such as playing fields for sports and for golf courses and the like, it is important that the risers of the sprinkler units reliably retract to a position level with the surface of the playing field, so that it does not become an obstacle on the playing field. It is desirable that they retract fully such that they do not interfere with normal activity on the playing field. However the typical riser of retractable sprinkler units frequently jams or sticks in the partially retracted position and fails to fully retract. The jamming frequently occurs due the frictional engagement of the seals on the surface of the retractable housing. It is also sometimes due to dirt and debris getting between the seal and the surface of the retractable riser. This results in the riser being jammed into position such that it will not retract. The seals also are subject to excessive wear between the riser and housing, resulting in excessive leaking.

It is, therefore, desirable that a simple, effective and inexpensive pop-up sprinkler unit for subsurface mounting having improved seal means be available.

SUMMARY OF THE INVENTION

It is, therefore, the primary object of the present invention to provide an improved subsurface pop-up sprinkler unit.

In accordance with the primary aspect of the present invention, a subsurface pop-up sprinkler unit comprising fixed outer housing and retractable pop-up inner sleeve or housing, is provided with a pressure activated seal that is normally retractable at reduced pressure and effective to seal at predetermined minimum pressure so that the seal does not contact the retractable riser while it is in motion between extension and retraction.

BRIEF DESCRIPTION OF THE DRAWING

The above and other object and advantages of the present invention will become apparent from the following description when read in conjunction with the accompanying drawings wherein.

DETAILED DESCRIPTION OF THE PREFERRED EMBODIMENTS

Figure 1:
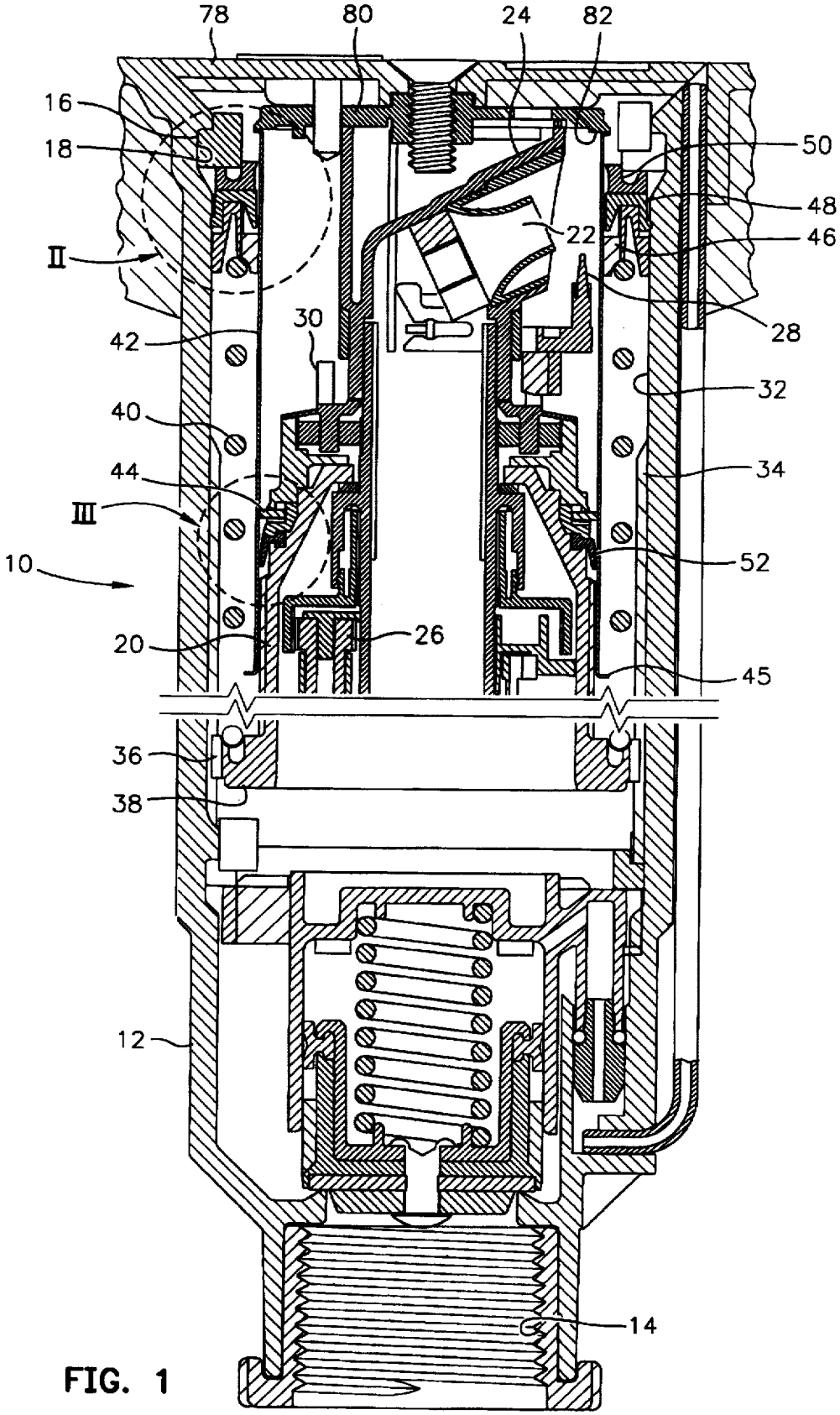
FIG. 1 is a side elevation view, in section, showing a sprinkler unit including a preferred embodiment of the present invention.

Referring to FIG. 1 of the drawings, there is illustrated a pop-up sprinkler unit constructed in accordance with a preferred embodiment of the invention, shown in the retracted position. The sprinkler unit, designated generally by the numeral 10, comprises a generally cylindrical outer housing 12, having an inlet opening or end 14 threaded for fitting to the end of a riser or the like for a source of pressurized water. An outlet end, which is normally oriented to be the top of the unit, is provided with a suitable retaining ring 16 detachably mounted therein by means of an annular recess 18 for retaining a retractably mounted inner housing in a suitable manner.

An inner tubular housing 20 is reciprocally mounted in the outer housing and includes a nozzle 22 mounted in an upper or outer end thereof. The nozzle is mounted in a rotatable head 24 and driven by means of turbine, not shown, and a reduction gear drive, a part of which is shown at 26, and as more fully described in many prior patents of assignee. The particular unit illustrated is designed to continuously rotate about a central axis of the housing. A stream interrupting pin 28 is intermittently extended into the stream of water by an annular series of cams 30 to break up and improve the distribution of the stream of water.

The inner housing 20 is reciprocally mounted within a bore 32 of the outer housing 12, and is oriented by internal ribs 34 and by means of teeth 36 on radial flange 38 at the lower end thereof. An elongated coil compression spring 40 engages shoulder or flange 38 at the lower end of inner housing 20, and is confined within the bore by means of ring 18 at the upper end. The spring 40 is compressed for biasing the inner housing or riser 20 to the lowermost or retracted position. The terms inner housing and riser are used interchangeably herein.

A grit or dirt resistant tubular sleeve 42 is reciprocally mounted and floats on a spacer ring 44 within a space between the inner housing 20 and the outer housing 12 in the illustrated embodiment. The sleeve 42 moves or is carried with and is considered a part of the inner housing 20. It will be apparent that in the function the same with or without the sleeve. In the absence of the sleeve 42, the seal 48 will act directly on the outer surface of the retractable housing 20. The sleeve is formed to have "grit resistant surfaces", which as used herein, means a surface having a hardness and finish, such that it will resist scratches, abrasion and embedding of fine grit or dirt particles into the surface at operating forces and pressures. This could include certain plastics, such as acetal plastics, commonly sold under the trademark Delrin. This sleeve, however, is preferably constructed of a sheet metal having a hard grit resistant outer surface to enable it to move through a layer of soil without grit from the soil becoming embedded therein.

The sleeve 42 is preferably constructed of a hard and durable sheet metal, such as stainless steel, to resist not only the abrasion from grit, but also rust, corrosion and the like. The sleeve is preferably on the order of between ten and thirty thousandths (0.010 to 0.030) and preferably approximately fifteen thousandths (0.015) of an inch in thickness, and is formed with a radial flange 45 at a lower end which engages an annular ring 46 of the upper end of housing 12.

This annular ring 46 is engaged by spring 40 and biases an outer annular seal assembly comprising a pressure responsive seal member 48 and a scraper ring 50 against cap annular retaining ring 16 at the upper end of the cylindrical bore 32 of the housing 12.

The sleeve 42 is floatingly disposed between the inner and outer housings, and serves as a protective cover for the nozzle and upper end of inner housing 20 as it moves between extended and retracted positions. The thinness of the sleeve 42 enables the use of a nozzle and inner housing having an outer diameter almost equal to the bore of the outer housing. The sleeve need have a length only sufficient to extend between upper or outer pressure responsive seal 48 at the upper end of the housing 12 and lower or inner pressure responsive seal 52 part way along the inner housing in both extended and retracted positions.

The sleeve 42 and inner housing 20 are provided with retracting means in the form of coil compression spring 40, which biases the inner housing to the retracted position (FIG. 1) when water pressure is shut off. The sleeve is frictionally supported between outer ring 46 and annular inner ring 44 near the upper end of the inner housing, and frictionally engaging the inner surface of the sleeve 42. The spring 40 is positioned between the annular flange 38 and guide ring 46 at the upper end of the housing 12, which biases against outer annular seal assembly members 48 and 50 retained in position by the retaining ring 16. The sleeve 42 floats on and is supported by the two opposing annular ring assemblies 44 and 46 between the outer and inner housings and occupies minimum space.

Figure 2:
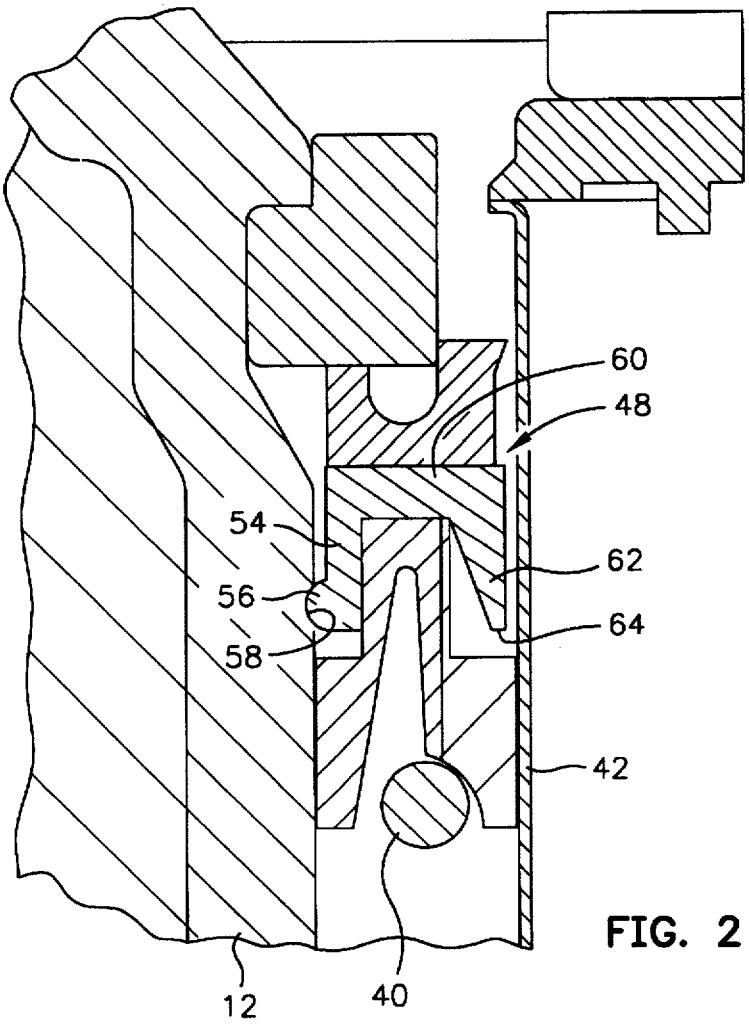
FIG. 2 is an enlarged side elevation view of a portion of FIG. 1, in section, showing an outer pressure responsive seal in accordance with the invention in the retracted position.
Figure 4:
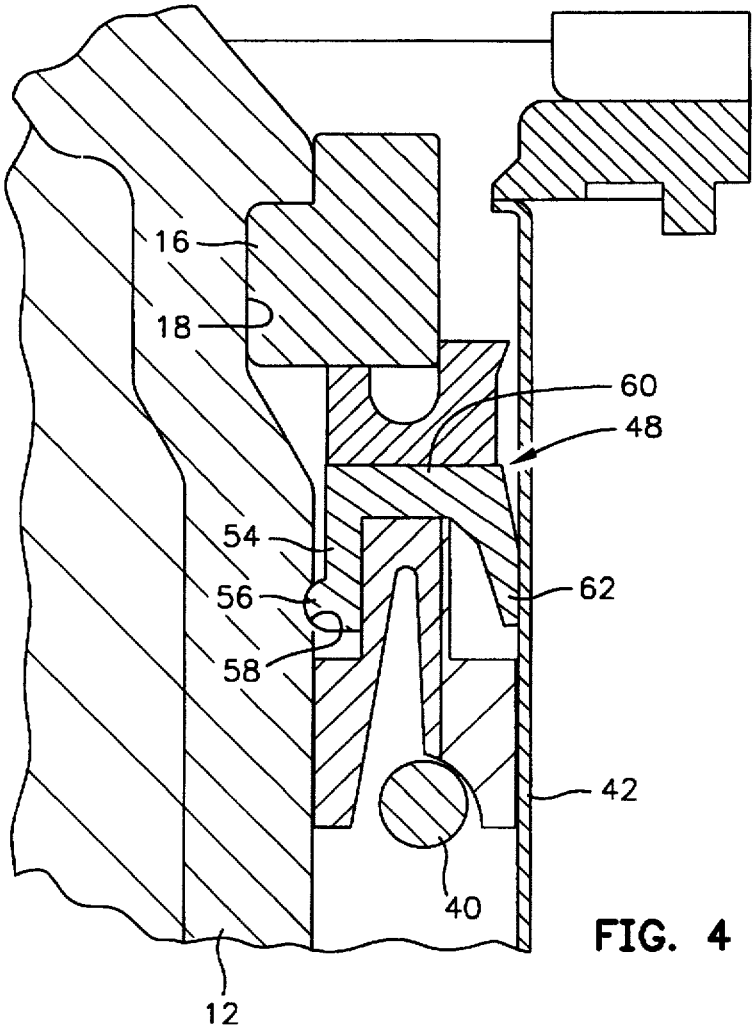
FIG. 4 is a view like FIG. 2, showing the outer pressure responsive seal in the extended position.
Figure 5:
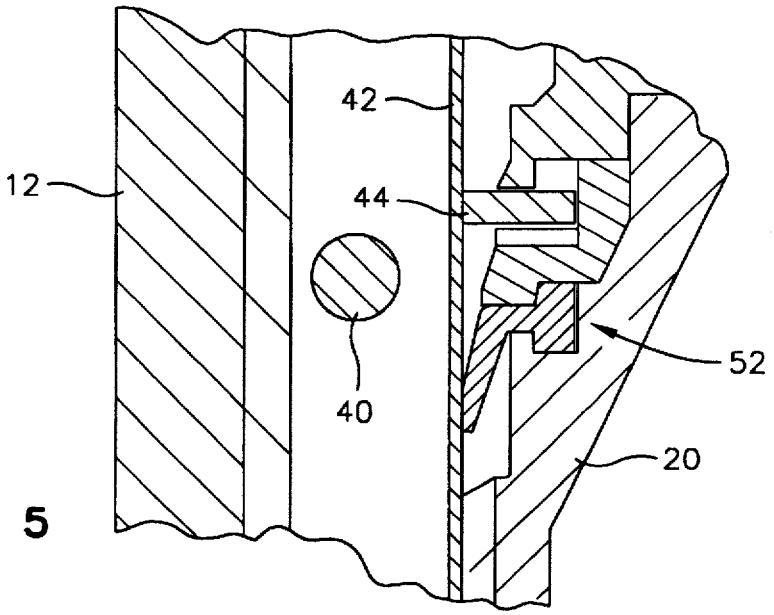
FIG. 5 is a view like FIG. 3, showing the inner pressure responsive seal in the extended position.

Referring to FIG. 2, the upper outer annular pressure responsive seal assembly comprises an annular elastomeric seal member 48 of a suitable material and configuration for performing the primary sealing function. The seal as illustrated has an annular configuration with a generally U-shaped cross section. It is formed with a base leg 54 with a ridge 56 for compressably engaging and sealing against the inner wall of the outer housing. A web section 60 connects between the base 54 and a downturned sealing lip 62 that is normally retracted away from the outer surface of sleeve 42 while under pressure is below a predetermined level as seen in FIG. 2. The seal lip 62 is tapered to a point or edge 64 extending toward the pressure source or retracted position of the inner housing. When pressure behind the seal exceeds a certain predetermined level, the seal lip extends or flexes inward toward the center axis into engagement with the surface of sleeve 42 as shown in FIG. 4.

Figure 3:
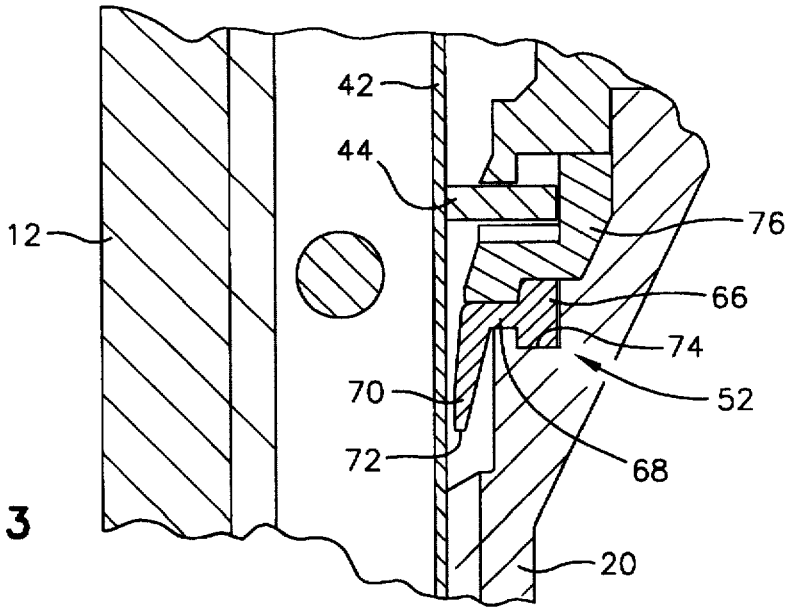
FIG. 3 is a view like FIG. 2, showing an inner pressure responsive seal in accordance with the invention in the retracted position.

Referring to FIG. 3, the inner seal assembly 52 is constructed in an annular configuration with a base 66 an intermediate leg 68 and a sealing lip 70. The lip 70 tapers to an edge 72 extending toward the source of pressure. The lip 70 and edge 72 is normally retracted away from the surface of the sleeve 42. The base 66 of the seal is captured in a groove 74 in inner housing 20 and a retaining ring 76 for mounting the seal in place. This seal is responsive to pressure below a predetermined minimum to retract away from the surface of the housing or sleeve as illustrated in FIG. 3. When the pressure exceeds that predetermined minimum, the seal lip 70 extends outward into sealing engagement with the sleeve 42 as shown in FIG. 4. This allows free movement of the sleeve or extensible housing until a certain minimum pressure has been reached. It also reduces the friction of the seals on the housing when water pressure has been cut off to allow the inner housing to easily retract.

In a preferred construction of the seal members, the moment of sealing contact between the lip of the seal and the housing is controlled by a deliberate relationship between the hydraulic pressure and atmospheric pressure acting on the inner and outer walls of the seal lip. The moment of activation can be designed to occur when the pop-up sprinkler riser has completed its motion upward to its fully extended position and stops. The moment of retraction can occur when the water pressure has been cut off and the riser starts to retract. The functioning of the seal can be controlled by proper selection of the elasticity and hardness of the seal material. The radial movement of the seal lip is sufficient so that no contact with the riser occurs when the riser is in motion, either up or down. This lack of contact eliminates wear of the seal or sealing surfaces and allows positive retraction of the riser by removing friction from riser to seal contact.

In the illustrated embodiment as shown in FIG. 1, a cap 78 protectively covers the nozzle and upper end of the inner housing in the retracted position. The sleeve 42 protectively covers them as they move through the soil into and out of the upper end of the outer housing. The sprinkler unit is designed to be buried beneath the soil a sufficient distance to avoid interference with a playing field or the like.

An inlet check valve 80 closes the lower end of the housing when water pressure is cut off.

In operation, when the sprinkler system is activated, pressurized water enters the inlet 14 at the end of the housing 12, opening valve 80 and pressurizing the interior thereof. This forces the inner housing 20 upward from the outer housing and protective sleeve 42 through the soil to a position where the upper end thereof is above the surface of the formation. As the cap 78 moves away from the upper end of sleeve 42, water from nozzle 22 begins spewing out, flushing soil and sand away from the upper end of the housing. The inner housing 20 continues to move upward with the nozzle 22 beyond the end of tube or sleeve 42 to expose or uncover the nozzle and enable the distribution of water. When the inner housing reaches its uppermost position, the water pressure increases to a predetermined pressure forcing the seals outward to the sealing position. When the water supply is shut off, the pressure within the inner housing and sleeve drops, the seals retract, the inner housing and nozzle 22 first retracting into sleeve 20, with shoulder 82 engaging the upper end of sleeve 42 so that the nozzle is protectively covered and moves downward into housing 12.

While we have illustrated and described our invention by means of specific embodiments, it is to be understood that numerous changes and modifications can be made therein without departing from the spirit and scope of the invention.

We claim:

1. A pop-up sprinkler unit for mounting beneath the surface of the soil of an earth formation, comprising:

an elongated outer housing member having a cylindrical through bore extending from an inlet for connecting to a source of pressurized water to an outlet end for receiving a retractable housing;

an elongated inner housing having an inner end and an outer end with a nozzle mounted on said outer end thereof reciprocally mounted in said bore and movable between a retracted position within said bore and an extended position wherein said outer end and said nozzle is extended from said outlet end of said bore, and said inner housing responsive to said pressurized water for extending to said extended position from said bore;

spring means for normally biasing said inner housing to said retracted position; and pressure responsive seal means disposed between said inner housing and said outer housing, said seal means having a base portion mounting said seal means to one of said inner and said outer housings, and said seal means including an annular lip extending toward said retracted position of said inner housing, and said lip being normally retracted from a surface of the other of said inner and said outer housing, and responsive to a predetermined minimum water pressure to extend into sealing engagement with the other of said inner and said outer housings.

2. A sprinkler unit according to claim 1 wherein said lip seal tapers from a wide base to a narrow portion at said sealing edge toward said source of water pressure.

3. A sprinkler unit according to claim 2 wherein said seal lip forms a cup with a wall of said one of said inner and said outer housing in which said seal means is mounted.

4. A sprinkler unit according to claim 3 wherein said pressure responsive seal means is responsive to extend into sealing engagement at the end of the extension travel.

5. A sprinkler unit according to claim 1 wherein said pressure responsive seal means is responsive to extend into sealing engagement at the end of the extension travel.

6. A sprinkler unit according to claim 5 wherein said seal lip tapers from a wide base to a narrow portion at said sealing edge toward said source of water pressure.

7. A sprinkler unit according to claim 1 further comprising an elongated grit resistant tubular sleeve having an inner end and an outer end mounted in said bore between said inner housing and said outer housing for moving with said inner housing in a protective position covering said nozzle between said retracted position and said extended position, and said seal means includes first seal means mounted on said outer housing for sealing engagement with an outer surface of said sleeve, and second seal means mounted on said inner housing for sealing engagement with an inner surface with said sleeve.

8. A sprinkler unit according to claim 7 wherein said seal lip tapers from a wide base to a narrow portion at said sealing edge toward said source of water pressure.

9. A sprinkler unit according to claim 7 wherein said pressure responsive seal means is responsive to extend into sealing engagement at the end of the extension travel.

10. A sprinkler unit according to claim 9 wherein said sleeve is formed of stainless steel sheet metal having a thickness of on the order of 0.010 and 0.030 inches, has a length that is less than that of said inner housing, has a radial shoulder at the inner end for limiting the outward extension thereof relative to said bore, is frictionally supported between first annular seal means at the outer end of said outer housing and second annular seal means near said outer end of said inner housing.

11. A pop-up sprinkler unit for mounting beneath the surface of the soil of an earth formation and having pressure responsive seal means, comprising:

an elongated tubular outer housing member having a coaxial through bore communicating from an inlet for connecting to a source of water to an outlet end for receiving a retractable nozzle;

an elongated inner housing having an outer end and an inner end with said nozzle mounted on said outer end thereof and said inner housing reciprocally mounted in said bore for movement between a retracted position within said bore and an extended position wherein said upper end and said nozzle are extended from said outlet end of said bore, and said inner housing being responsive to a source of pressurized water for extending to said extended position;

an elongated grit resistant tubular sleeve having an inner end and an outer end mounted in said bore between said inner housing and said outer housing and carried by ribs on said inner housing for extending with said inner housing from a first extended position of said nozzle through a covering earth formation from said bore, and for being held in an extended position by said outer housing when said inner housing extends to a second position wherein said nozzle is extended from said sleeve;

first pressure responsive seal means disposed between said inner housing and an inner surface of said sleeve; and second pressure responsive seal means disposed between said outer housing and an outer surface of said sleeve, said first and said second seal means having a base portion mounting said seal to one of said inner and said outer housings, and said seal means including an annular lip extending toward said retracted position of said inner housing, and said lip being normally retracted from a surface of said sleeve, and responsive to a predetermined minimum water pressure to extend into sealing engagement with the other of said inner and said outer housings.

12. A sprinkler unit according to claim 11 wherein said seal lip tapers from a wide base to a narrow portion at said sealing edge toward said retracted position of said inner housing.

13. A sprinkler unit according to claim 12 wherein said pressure responsive seal means is responsive to extend into sealing engagement at the end of the extension travel of said inner housing.

14. A sprinkler unit according to claim 11 wherein said pressure responsive seal means is responsive to extend into sealing engagement at the end of the extension travel of said inner housing.

15. A sprinkler unit according to claim 11 wherein said first seal means includes a friction seal for frictionally supporting said sleeve.

16. A pop-up sprinkler unit having pressure responsive seal means, comprising:

an elongated outer tubular housing having a cylindrical bore with inlet means for attachment to a source of pressurized water and outlet means communicating with said bore;

an elongated inner tubular housing having a nozzle mounted on an outer end thereof reciprocally mounted in said cylindrical bore for movement between a retracted position wherein said nozzle is encased within said outer tubular housing and an extended position wherein said nozzle is cooperatively extended from said outer tubular housing;

elongated tubular stainless steel sleeve reciprocally mounted in and disposed between said outer housing and said inner housing for movement with said inner housing between a retracted position, and an extended position extending from the outlet end of said bore wherein said nozzle extends from an outer end of said sleeve;

a pressure responsive annular outer seal member at said outlet end of said outer housing surrounding said sleeve and responsive to a predetermined water pressure for extending into sealing engagement with an outer surface of said sleeve; and a pressure responsive annular inner seal member adjacent said outlet end of said inner housing extending around for gripping the inner surface of said sleeve and responsive to a predetermined water pressure for extending into sealing engagement with an outer surface of said sleeve.

17. A sprinkler unit according to claim 16 wherein said pressure responsive seal means is responsive to extend into sealing engagement at the end of the extension travel of said inner housing.

18. A sprinkler unit according to claim 17 wherein said lip seal tapers from a wide base to a narrow portion at said sealing edge toward said retracted position of said inner housing, said sleeve includes a radial shoulder at said inner end for engagement with said outer housing for retaining said sleeve in said first extended position.

19. A sprinkler unit according to claim 18 wherein said sleeve has a length of less than that of said inner housing, is frictionally supported between said first annular seal means at the outer end of said outer housing and said second seal means near said outer end of said inner housing, said sleeve includes a radial shoulder at said inner end for engagement with said outer housing for retaining said sleeve in said first extended position.

* * * * *